United States Patent [19]

Markakis

[11] 4,085,836

[45] Apr. 25, 1978

[54] ROTARY MAGNETIC STORAGE MEDIUM FOR TYPEWRITERS

[75] Inventor: Michael J. Markakis, Palo Alto, Calif.

[73] Assignee: SCM Corporation, New York, N.Y.

[21] Appl. No.: 632,632

[22] Filed: Nov. 17, 1975

[51] Int. Cl.[2] ..... B41J 5/30

[52] U.S. Cl. ..... 197/19; 197/1 R; 360/97

[58] Field of Search ..... 197/1 R, 19, 20, 64, 197/84 A, 84 R; 235/60, 12; 360/78, 86, 87, 97, 100, 106

[56] References Cited

U.S. PATENT DOCUMENTS

| | | | |
|---|---|---|---|
| 2,609,907 | 9/1952 | Lynch | 197/19 |
| 2,751,274 | 6/1956 | Andrews | 360/97 X |
| 2,765,895 | 10/1956 | Higgonet et al. | 197/19 |
| 2,769,518 | 11/1956 | Faulkner et al. | 197/20 |
| 2,997,152 | 8/1961 | Dirks | 197/1 R X |
| 3,063,536 | 11/1962 | Dirks | 197/19 |
| 3,134,097 | 5/1964 | Stevens et al. | 360/106 X |
| 3,250,367 | 5/1966 | Lubkin | 197/19 |
| 3,258,750 | 6/1966 | Shew | 360/97 |
| 3,265,874 | 8/1966 | Soule et al. | 235/60.12 X |
| 3,350,699 | 10/1967 | Schmidt | 360/78 |
| 3,656,761 | 4/1972 | Laschenski | 360/78 |
| 3,756,365 | 9/1973 | Markakis | 197/1 R |
| 3,770,905 | 11/1973 | Sperry | 360/106 |
| 3,788,441 | 1/1974 | Vartanian et al. | 197/1 R |
| 3,947,886 | 3/1976 | Hiedecker et al. | 360/86 X |

*Primary Examiner*—Ernest T. Wright, Jr.
*Attorney, Agent, or Firm*—Armand G. Guibert; Milton M. Wolson

[57] ABSTRACT

A machine for simultaneously making typewritten and magnetic records, for editing magnetic records, and for automatically making typewritten copies of the magnetic record. A magnetic memory (a disc, say) is driven by the motor in the typewriter with the drive arrangement having a flywheel for reducing variations in memory speed, and a writing and reading transducer head is moved concomitantly with line feed of the printed record. The magnetic recording medium has concentric (or parallel) storage tracks so that each line appearing on the printed record is separately recorded in a different storage track of the memory to provide for easy editing and allow a simplified system for recording and playback.

14 Claims, 2 Drawing Figures

ROTARY MAGNETIC STORAGE MEDIUM FOR TYPEWRITERS

BACKGROUND OF THE INVENTION

1. Field of the Invention

This invention relates to editing typewriter systems of the kind which simultaneously make printed and magnetic records and have the capability of automatically and rapidly making printed copies of the magnetically recorded entries. More specifically, the present invention employs a novel recording unit arrangement at the typewriter instrument and a novel system for recording and replaying the desired characters.

2. Description of the Prior Art

Editing typewriter systems are well known and in commercial use. Such systems are comparatively expensive and require certain restraints in their operation. For instance, in known machines such as that disclosed in U.S. Pat. No. 3,413,624, the keyboard data and format instructions are stored in a tape and therefore they appear sequentially and operator coordination of the tape and text for preparation of error-free copy is difficult. One solution to that problem was disclosed in U.S. Pat. Nos. 3,756,365 and 3,788,441 (both assigned to the assignee of this application), but had an inherent weakness in that association of the magnetic card recording with the motion of the platen carriage resulted in variable density of the magnetic pattern. To avoid variable density of recording, a separate drive for the recording action of a magnetic head supported by the platen carriage was disclosed in U.S. Pat. No. 3,819,024, also assigned to the assignee of this application, but this requires structure of greater complexity. Accordingly, there is need of an improved machine for simultaneous preparation of typewritten and magnetic records with ease of editing by the operator, the magnetic record then being available for reproduction at the option of the operator.

SUMMARY OF THE INVENTION

It is an object of the present invention to provide a novel editing typewriter system employing a magnetic recorder having parallel recording tracks (i.e., concentric in the case of a disc) with the positioning of a single transducer head correlated with or coupled to the printing unit line spacing (i.e., "line feed") function.

In the present invention, the magnetic memory unit is used to store entries made at the keyboard on a line-by-line basis. No prescribed line or character sequencing is required of the operator. Corrections, additions, or deletions can be made at any location on the copy with only the final result remaining in the magnetic memory (or storage) unit.

A further object is to provide a novel typewriter structure employing a magnetic disc as a memory unit wherein the transducer head is mechanically coupled to move concomitantly with the line feed.

A still further object is to provide a novel typewriter and revolving magnetic disc memory unit, both driven by the same electric motor, and preferably employing a flywheel to minimize variations in disc speed, where the disc is revolving continuously, or as part of a clutch arrangement in order to provide more rapid acceleration to a desired velocity, where the disc moves on an incremental basis.

A yet further object is to provide a novel system for recording and replay, utilizing preamble and postamble signals to eliminate the need of indexing the memory unit for proper location of the recorded signals.

These and other advantages of the invention will become more fully apparent from the claims, and from the description given below.

BRIEF DESCRIPTION OF THE DRAWING

The detailed description of the preferred embodiments of the invention will be given in conjunction with the appended drawing wherein.

DETAILED DESCRIPTION OF THE PREFERRED EMBODIMENTS

Figure 1:
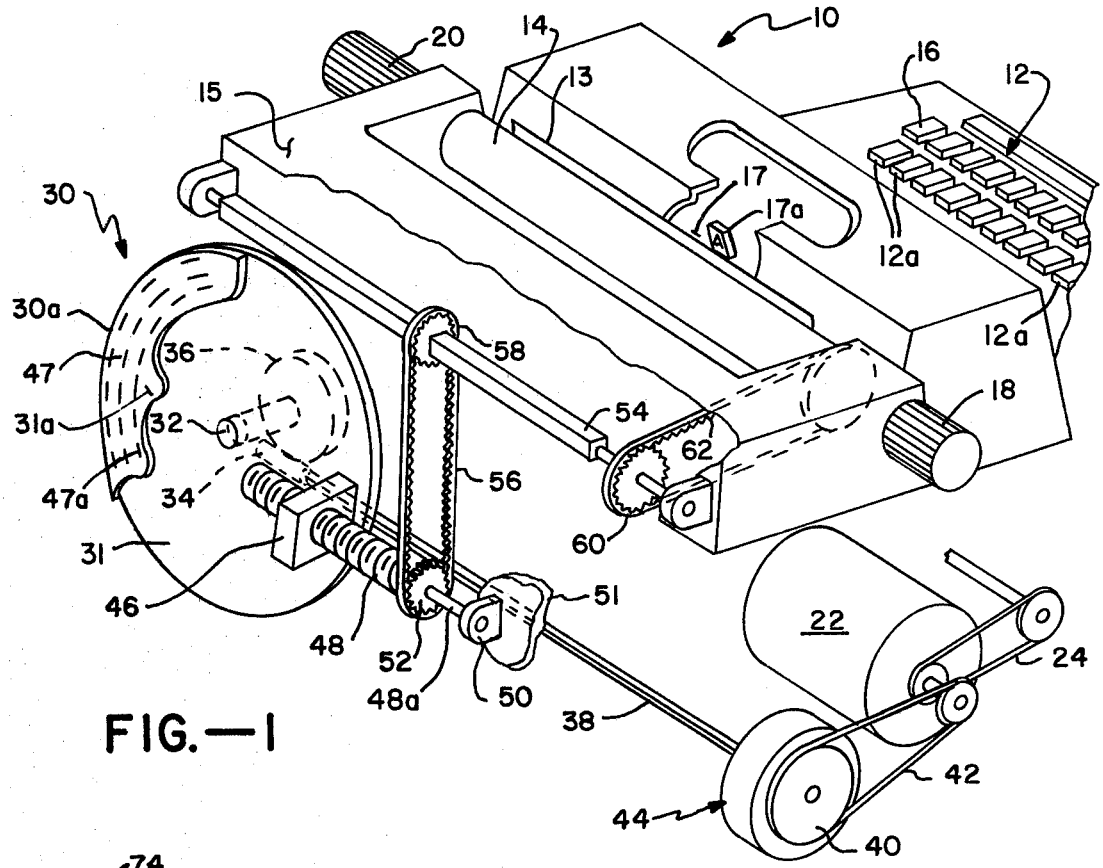
FIG. 1 is a pictorial view of a typewriter having a revolving disc memory unit in accordance with the present invention.

Referring first to FIG. 1, the present invention is illustrated as comprising a printing unit in the form of a typewriter 10 having a keyboard 12 and a printing platen 14 supporting a record sheet 13. The typewriter 10 may be of any conventional construction such as where platen 14 is on a movable carriage 15 and the printing point 17 is stationary as shown in FIG. 1, print members **17*a* being brought to printing point 17 successively, as is well known. Alternatively, platen 14 may be axially stationary and a printing head bearing a plurality of print members 17*a* may be moved to successive points across sheet 13, again in known fashion (see U.S. Pat. No. 2,879,876). In electric typewriters, keyboard 12 normally contains a line feed/carriage return key 16, depression of which effects a relative movement between platen 14 on movable carriage 15 (FIG. 1) and the printing point 17 so as to bring the first character position of a line on sheet 13 in alignment with printing point 17 and simultaneously advances record sheet 13 to a new line as by rotation of printing platen 14 (counterclockwise in FIG. 1). Knobs 18 and 20 on opposite ends of printing platen 14 can be manually operated to rotate platen 14, thereby bringing record sheet 13** to any desired line position, as is shown.

As illustrated in FIG. 1, typewriter 10 contains a drive motor 22 which may be coupled either directly or by a belt 24, to drive the snatch roll (not shown) or comparable typebar actuating element of print members **17*a*** in a conventional manner.

A magnetic memory or storage unit 30 in the illustrated embodiment is mounted on a shaft 32 journaled for rotation in suitable bearings (not shown) on typewriter 10. Shaft 32 has a gear 36 fixed thereon which engages a worm 34 rigidly connected to a worm shaft 38 driven by a pulley 40 through a second belt 42 from motor 22, which motor is also used to operate typewriter 10, as mentioned previously. Pulley 40 may include a large mass which serves as a flywheel 44 to reduce any fluctuations in rotational speed of magnetic storage unit 30 which might otherwise occur during the intermittent loading of motor 22 which results upon operation of keyboard 12, particularly the carriage return function initiated by depression of key 16. By this technique, magnetic memory unit 30 may be added to a conventional typewriter 10 and operated with the same motor 22 that is normally required for satisfactory typewriter operation or with only a modestly larger one.

In embodiments where memory unit 30 operates on an intermittent basis, flywheel 44 may be part of a friction clutch (not shown, but known) and used to accelerate the memory unit 30 quickly to its desired speed. Intermittent operation is contemplated wherein a group of characters constituting an entire line on the printed page i.e. record sheet 13 are recorded on memory unit 30 during one operation, or where characters are entered on an incremental basis of one or two at a time. Friction clutches such as are used in printing telegraph printers may be employed where operation is intermittent as opposed to continuous. Where the memory unit 30 is driven continuously, a speed on the order of 300 rpm has been found satisfactory.

With the memory unit 30 as shown in FIG. 1, a removable disc 30*a* having a surface 31 covered with a magnetizable material or medium 31*a* may be used with a transducer 46, such as a magnetic write/read head of conventional construction.

Transducer 46 is supported on the typewriter frame 51, for instance, and in such fashion as to permit movement radially along disc 30*a*. Each storage track 47 on disc 30*a* forms a narrow circular band concentric with shaft 32 to thus provide the desired number of storage locations, selectable by moving transducer 46 radially into alignment with a desired one of the tracks 47 where it remains until moved radially to an adjacent track 47*a* in response to line feed of sheet 13. Certain concepts of the present invention can be used with belt or drum memories of the general type, as shown for example in U.S. Pat. No. 2,751,274 to Andrews.

A lead screw 48 is mounted on the typewriter 10 so that its axis is parallel to the axis of platen 14, and journaled in suitable bearings 50, fixed on a portion of the frame 51 of typewriter 10, so as to allow rotation but no axial movement. Transducer 46 has internal threads (not shown) engaging lead screw 48 and is slideably mounted in guideways (not shown, but known) which permit only translational motion of transducer 46 along the axis of lead screw 48 as this last is rotated.

Fixed to the shaft 48*a* of lead screw 48 is a gear 52 which is coupled to a non-circular shaft 54. The coupling may be effected by a toothed belt 56 engaging a gear 58 mounted for sliding movement along the non-circular shaft 54 to thereby allow shaft 54 to be supported on movable carriage 15 with the axis of shaft 54 parallel to the axis of lead screw 48. Non-circular shaft 54 has affixed thereon a gear 60 driven by a chain or toothed belt 62 to rotate with the rotation of platen 14. Thus, any time that transducer 46 is to be moved, the operator can cause the desired displacement by turning platen 14, and place transducer 46 in alignment with a predetermined one of the tracks 47 on memory disc 30*a*. Such manually-controlled displacement is particularly useful when setting transducer 46 to an extreme track location corresponding to the start of a new page, say, or when selecting particular lines of prerecorded information for insertion at predetermined locations in a document i.e., record sheet 13.

Figure 2:
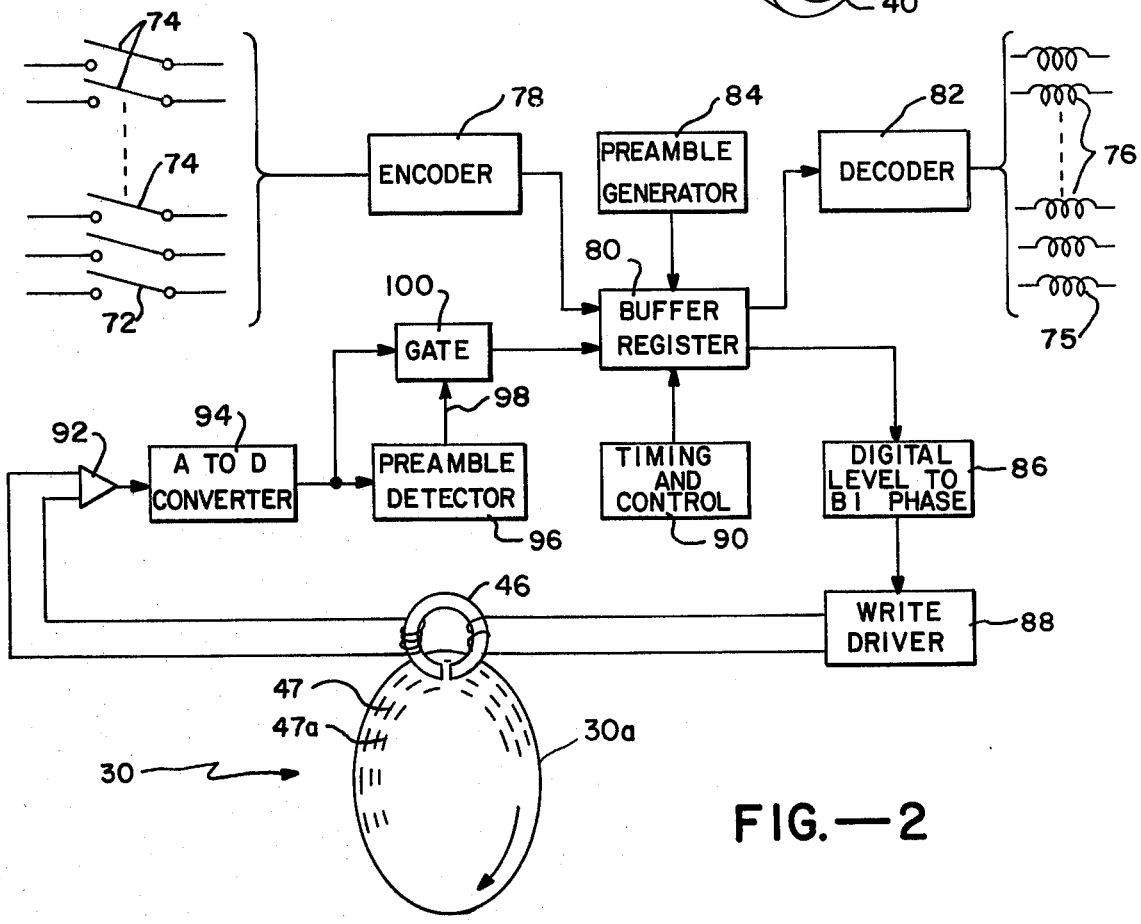
FIG. 2 is a schematic block diagram of the system of the editing typewriter illustrated in FIG. 1.

Referring now to FIG. 2, the memory disc 30*a* is shown schematically with various blocks for the circuit elements necessary to implementation. It is noted here that as an alternative embodiment (not shown in either figure), transducer 46 may be mounted on an arm capable of rotation under control of a direct mechanical connection to platen 14 in fashion similar to that illustrated in FIG. 1, or by a stepper motor mechanism of a known type operated — for example — by closure of contacts 72 associated with the line feed/carriage return key 16 on typewriter keyboard 12. The preferred operation in either case, allows one line of printed words to be recorded on each track 47 of memory unit 30, and then concomitantly with the advancement of platen 14, the transducer 46 is advanced to a new recording track e.g. 47*a*. Two or more lines may be recorded in a single track 47 by sectoring the disc 30*a* (for otherwise dividing the recording path length of the particular form of magnetic memory 30 — belt, drum, etc.). Though possible, and contemplated, this is not the most preferred form, however, because it requires addition of an index (not shown) to the disc 30*a* or to each track 47 and devices to sense the presence of the index together with counters or other devices for identifying the successive subdivisions of the tracks 47 in known fashion (see U.S. Pat. No. 3,265,874, for instance). Moreover, the drive connection (60, 62) between platen 14 and the positioning elements (48, 52, 56, etc.) for transducer 46 cannot then be positive because the repositioning of transducer 46 must only occur after a given number of lines have been printed. In that case, stepping of transducer 46 to the next track 47*a* may be controlled, for instance, by sensing of the abovementioned index after the information stored in the buffer register 80 has been recorded in the last subdivision of the track 47.

Switches 72 and 74 on the left side of FIG. 2 and solenoids 75 and 76 on the right side of that figure are associated respectively with the line feed/carriage return key 16 and the character keys 12*a* of keyboard 12 (see FIG. 1). When the system is in a recording operation, closure of a switch 74 is fed to encoder 78 where the code for the typed character is first entered into buffer register 80 and then into the memory unit 30, as will be described. When the system is in a replay operation, the character codes stored in the memory unit 30 are transferred to buffer register 80 and through decoder 82 to a respective solenoid 76 to cause printing of that character on the record sheet 13. Function codes will similarly be translated into signals actuating respective solenoids (not shown, but similar to solenoids 76), the carriage return code causing selection of the solenoid 75, for example. The modifications to a conventional electric typewriter 10, the encoder 78, and the decoder 82 may be of any known type, such as shown in U.S. Pat. Nos. 3,265,874 to Soule et al, or 3,413,624 to Murdoch et al.

During a recording operation, the initial signal entered on each track 47 may be from preamble signal generator 84. The output signals originating from the closures of switches 74 are customarily converted by encoder 78 into coded signals in a parallel form and then supplied seriatim to buffer register 80. The output signals from buffer register 80 are customarily supplied in a serial form to a digital level-to-bi-phase circuit 86 and to write driver circuit 88 to be serially recorded on memory unit 30, all as is well known in the art.

The timing and control circuit 90 can set the system in the record or the replay mode, and thus provide binary coded information and control signals at appropriate times, by techniques well known to those familiar with this art.

If the memory disc 30*a* is driven continuously, it is preferable to provide buffer register 80 with a storage capacity sufficient to hold an entire line of characters so that the full line is available for entry in the memory disc 30*a* in one revolution. The carriage return signal produced by the closure of switch 72 may conveniently be used to initiate recording of the above-mentioned initial or "preamble" signal followed by recording of the characters stored in buffer register 80 and a postamble signal prior to movement of transducer 46 to the next storage track 47*a* of disc 30*a* as platen 14 is indexed forward at the completion of the carriage travel. Such an arrangment requires that all the characters in a line be located in a single circular track 47*a* on disc 30*a* with no overlap. For this purpose, the timing and control circuit 90 may comprise a multivibrator circuit (not shown, but known) the frequency of which is chosen in terms of the rotational speed of disc 30*a*, so as to assure that one entire line can be recorded without overlap of the recorded data. Removal of old information remaining between the postamble and preamble signals is assured by applying an erasing (saturation) current in that interval, in known fashion, prior to or after recording the data.

Suitable delays of known type can be employed to provide either for completion of recording and then movement of transducer 46 to a new track 47*a*, or for movement of transducer 46 first to a new track 47*a* and then start of the recording operation. In either case, the exact angular orientation of disc 30*a* at which recording on the storage track 47 takes place is not important. No index marker need be employed. The first signal recorded is always a preamble signal and the last signal recorded is the postabmle signal (except for the above-mentioned saturation erasure, of course).

In the replay mode, the signals from transducer 46 are applied through an amplifier 92 to the analog-to-digital converter 94 and monitored until a preamble signal is detected by preamble detector 96. Upon detection of a preamble signal, gate 100 is opened via an output on line 98 from detector 96 to allow the recorded line of characters to move into buffer register 80. From buffer register 80, these signals are then successively applied to decoder 82 to thereby energize the appropriate solenoids 76 which print the corresponding characters in proper order, as is well known in the art. The reception of the postamble signal, preferably the carriage return signal, may be used to control line feed of typewriter 10 and move transducer 46 to the next information track 47*a* on memory unit 30. In the embodiment (see FIG. 2), actuation of the line feed/carriage return mechanism (not shown, but known) by the corresponding solenoid 75 causes advancement of the transducer 46 through rotation of platen 14, as previously described.

While memory unit 30 has been described as being a magnetic disc, 30*a* it is evident that certain concepts of the present invention are useful with magnetic drums or belts. Furthermore, instead of the memory unit 30 being driven continuously, it is also contemplated that an incremental motion may be used with the drive to the memory unit 30 employing a momemtarily energized clutch, as is well known in the art. In this case, buffer register 80 may be of a much smaller size, even of a size sufficient to handle only one character at a time. In all events, the buffer register 80 is of the first in/first out type. It is also contemplated with respect to the incremental mode of operation (although equally applicable to the continuous mode) that depression of the carriage return key 16 may cause entry of a postamble signal in the track 47 which is then in cooperative relationship with transducer 46, thus marking the end of character entry in that track 47.

The invention is adapted to allow for preparation of multipage documents by use of many small discs 30*a* which each hold one page or alternatively — with some increase in complexity — by use of a few large, sectored discs 30*a*. Formatting of the page can easily be controlled by the operator, and subsequent copies are edited always with the most recent requirements. The invention provides for the continuous replay of recorded characters at a high speed, limited only by the capability of the printing unit.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. In combination with a typewriter having a keyboard and print members together with a platen for holding and feeding a printing medium to produce printed copy, and including a manually operable key for controlling line feed of the platen:

an indexless magnetic storage medium mounted on said typewriter for rotational movement through plural revolutions, means defining a large number of spaced storage tracks adjacent one another on said storage medium, a single transducer effective to enter characters into and read characters from said tracks during the rotational movement of the storage medium, means mounting said transducer on the typewriter in operative relation to the storage medium, means for moving said transducer from one storage track to an adjacent track in cooperation with said track-defining means and only in response to line feed of said printing medium, means operable independently of the rotational orientation of said storage medium and responsive to actuation of the line feed key during a recording operation for recording a variably-located preamble signal and a postamble signal relative to the characters entered in said storage medium, and means responsive to receiving the postamble signal during replay operation for actuating line feed of the printing medium.

2. The combination as defined in claim 1, further including a single electric motor mounted on said typewriter and connected to operate discrete elements of the typewriter including the print members, in response to actuation of keys on said keyboard, said motor being also connected to cause said rotational movement of said magnetic storage medium and including a flywheel to reduce thereby fluctuation in the rotational speed of the storage medium as the typewriter is operated.

3. The combination as defined in claim 1 wherein the storage medium is a disc having a side surface with magnetizable material thereon and further including means for driving said disc continuously.

4. The combination as defined in claim 3 further including:

signal-controlled means for operating said print members, register means connected during a recording operation to receive characters entered on said keyboard and to transfer the entered characters to said storage medium, and connected during a replay operation to receive characters from said storage medium and to provide signals representative of the received characters to operate thereby said print members.

5. The combination defined in claim 4, wherein said actuation of the line feed key causes transfer of the register characters to said storage medium preceded by the preamble signal and terminating with the postamble signal, prior to a shift of said transducer to a next one of said tracks.

6. The combination as defined in claim 4 wherein said platen is rotatable to line feed the printing medium, said transducer mounting means includes a threaded shaft for causing movement of said transducer along said shaft in response to rotation of the shaft, and wherein said means for moving said transducer includes a direct drive connection between the rotatable platen and the shaft supporting said transducer, thereby turning said shaft concomitantly with rotation of said platen.

7. The combination as defined in claim 1 wherein said platen is rotatable to line feed the printing medium, said transducer mounting means includes a threaded shaft for causing movement of said transducer along said shaft in response to rotation of the shaft, and wherein said means for moving said transducer includes a direct drive connection between the rotatable platen and the shaft supporting said transducer, thereby turning said shaft concomitantly with rotation of said platen.

8. The combination as defined in claim 1 further including: signal-controlled means for operation of said print members, register means connected during a recording operation to receive characters entered on said keyboard and to transfer said characters to said storage medium, and connected during a replay operation to receive characters from said storage medium and to provide signals representative of received characters to operate thereby said print members.

9. The combination defined in claim 8, wherein said actuation of the line feed key causes said postamble signal to be recorded in said one storage track, followed by a shift of said transducer to said adjacent storage track.

10. In combination with a printing unit having a keyboard containing an operator-controlled line feed member actuatable for moving a printed page on a line-by-line basis, a memory device having discrete number of spaced storage tracks substantially equal in amount to the number of lines in the printed page, said memory device being indexless and rotatable through plural revolutions, a single transducer effective to enter data into and read data from said memory device and being selectably movable to cooperate with a desired one of said tracks, means for moving said transducer from one storage track to another storage track in response to actuation of the line feed member, register means connected during a recording operation to receive characters entered on said keyboard and to transfer said characters to said memory device, and connected during a replay operation to receive characters from said memory device and to transfer the received characters to said printing unit, means operable during a recording operation independently of the rotational orientation of said memory device and effective to record a postamble signal in a discrete storage track and a preamble signal in the next storage track, said signal recording means including at least means responsive to actuation of the line feed member and said preamble signal being variably located in said next storage track, means responsive to sensing of the preamble and postamble signals in each track by said transducer, for initiating and terminating reception of characters from each said track, and means responsive to the postamble signal during a replay operation for actuating the line feed member of said printing unit.

11. The combination as defined in claim 10 wherein said transducer moving means comprise a threaded shaft mounted on the printing unit for carrying said transducer, and means connected between the line feed member of the printing unit and said threaded shaft for moving the transducer from one storage track to the next storage track concomitantly with the actuation of the line feed member.

12. The combination as defined in claim 10 wherein the memory device is a disc drivably mounted on said printing unit and the printed page is line fed by intermittent rotation of a platen, and the combination further includes a single electric motor and a flywheel for operating the printing unit, including the line feed member, and also for movement of the transducer and driving of the memory device.

13. The combination as defined in claim 10 wherein the printed page is line fed by intermittent rotation of a platen mounted on a movable carriage, and said transducer moving means comprise a threaded shaft for carrying said transducer, said shaft being rotatably mounted on the printing unit parallel to the platen, and means comprising a non-circular shaft rotatably mounted parallel to said threaded shaft and an axially fixed gear member mounted to turn with and slide longitudinally on said non-circular shaft and being connected between said platen and said threaded shaft for moving the transducer from one storage track to the next storage track concomitantly with the rotation of said platen.

14. The combination as defined in claim 10, wherein said actuation of the line feed member causes said postamble signal to be recorded in said discrete storage track, followed by a shift of said transducer to said next storage track.

* * * * *